United States Patent [19]

Fukuma

[11] Patent Number: 4,902,863

[45] Date of Patent: Feb. 20, 1990

[54] PUSH BUTTON MICROSWITCH WITH WIPING CONTACT EFFECT

[75] Inventor: Yasumichi Fukuma, Hirata, Japan

[73] Assignee: Omron Tateisi Electronics Co., Kyoto, Japan

[21] Appl. No.: 323,153

[22] Filed: Mar. 15, 1989

Related U.S. Application Data

[63] Continuation of Ser. No. 97,034, Sep. 14, 1987, abandoned.

[30] Foreign Application Priority Data

Sep. 16, 1986 [JP] Japan ..... 61-140607
Sep. 16, 1986 [JP] Japan ..... 61-140608
Sep. 16, 1986 [JP] Japan ..... 61-140609

[51] Int. Cl.[4] ..... H01H 5/06

[52] U.S. Cl. ..... 200/445; 200/459; 200/467

[58] Field of Search ..... 200/467, 459, 452, 445, 200/462

[56] References Cited

U.S. PATENT DOCUMENTS 3,030,465 4/1962 Roeser ..... 200/463
3,394,403 7/1968 Dennison ..... 200/467 X
4,673,778 6/1987 Lewandowski ..... 200/467

FOREIGN PATENT DOCUMENTS 1201450 8/1962 Fed. Rep. of Germany .... 200/67 B
2262995 12/1972 Fed. Rep. of Germany .... 200/67 B
197701 4/1966 U.S.S.R. ..... 200/67 B

*Primary Examiner*—Renee S. Luebke
*Attorney, Agent, or Firm*—Wegner & Bretschneider

[57] ABSTRACT

A switch is disclosed having a movable piece with a movable contact and a movable plate coil, a fixed terminal provided with a fixed contact facing the movable contact, a movable coil spring with an end being fixed at a standing piece of a common terminal, wherein the other end of the coil spring is coupled to the end of a movable piece, and wherein the movable plate coil is biased by the movable coil spring with one end of the movable plate coil swingably held by a holding piece of the common terminal, and a push-button for pressing the upper portion of the movable coil. The switch has an actuator having a supporting member which rotatably engages with the case, wherein the supporting member is formed in a plane generally perpendicular to a rotary shaft of the actuator.

10 Claims, 7 Drawing Sheets

PUSH BUTTON MICROSWITCH WITH WIPING CONTACT EFFECT

This application is a continuation of U.S. application Ser. No. 097,034, filed Sept. 14, 1987, now abandoned.

BACKGROUND AND SUMMARY OF INVENTION

There are several types of microswitches. The prior art microswitch shown in FIG. 5 has a movable contact 51 which is provided at an end of movable piece 54. The other end of the movable piece 54 is fixed at an end of holding piece 53. The movable piece 54 can swing around the holding piece 53 which is a portion of a common terminal 52. Fixed contacts 55 and 56 are connected to fixed terminals 57 and 58, respectively. A coil spring 60 is provided between standing member 59 and a middle portion of movable piece 54. A push-button 61 is disposed to push the coil spring 60 in the free position of the switch, wherein the movable contact 51 is on the upper fixed contact 55. If the push-button 61 is pressed down the coil spring 60 is distorted downwardly so that the movable piece 54 is clicked down around the other end to make the movable contact 51 with the fixed contact 56, thus, performing a switching operation.

FIG. 6 shows another type of conventional microswitch. A movable piece 64 has a movable contact 62 and a movable plate spring 63, one end of which rests on a holding piece 69 which is made in one piece with a common terminal 70. Fixed contacts 65 and 60 are connected to fixed terminal 67 and 68, respectively. Push-button 72 is provided to push receiving member 71, both ends of which are connected to common terminal 70 and the end portion of movable piece 64. In the free position of this switch a movable contact 62 rests on fixed contact 65. When push-button 72 is pushed down, the end of movable piece 64 is moved downwardly through the receiving member 71. When movable piece 64 passes over a certain point, movable plate spring 63 turns around to make its movable contact 62 with fixed contact 60.

The switch shown in FIG. 5 is simple in construction, but in its switching operation, movable piece 54 swings around a holding piece, so that a wiping effect by movable contact 51 cannot be expected. The wiping effect of movable contact 51 is necessary for avoiding the welding of contacts often observed in this type of high-capacity switch. More specifically, an arc flows between contacts when a switch makes and breaks to weld the contacts. Wiping is required to remove melted substance from the surface of contacts and to improve the reliability of switch operation. On the other hand, in the switch shown in FIG. 6, the swinging point of receiving member 71 is located under the conjunction point of receiving member 71 and movable piece 64, so that when pushbutton 72 is pressed down, the movable piece 64 moves a little bit backward. Therefore, when the movable contact 62 comes away from fixed contact 65, it can have a wiping effect on the fixed contact 65. However, this type of switch needs receiving member 71, which makes the structure more complicated.

The actuator 18 which is positioned to cover the push-button 12 can be modified as shown in FIGS. 7–9. Initially, however, an actuator in the prior art has been illustrated in FIGS. 10–11. Shown in FIG. 10 is a switch having a switching mechanism contained in case 101 which has a push-button 102 and an actuator 103 for pressing on the button 102. The actuator 103 is a metal plate, a portion of which is folded downwardly to form a regulating member 104. A pair of actuator portions 105 are formed as supporting members for the actuator 103, while the other end of the actuator 103 is folded to form a pair of roller supporting members 109. Both sides 101B of the case 101 have cuts 101D at the corners of case 101. A pin 106 is formed with one piece with the case 101 to permit the supporting members 105 to be rotatably engaged. A roller 108 has a rotary shaft 107 which is coupled to roller supporting member 109. The actuator 103 which is rotatably supported by the pin 106 is positioned over the push-button 102. Normally, the actuator 103 is held up by the restoring force of the push-button 102. When an object hits the roller 108, the actuator 103 moves around pin 106 and pushes the push-button 102 against its restoring force, thus, operating the contact switching mechanism housed within the case 101. After the depressing force is removed from the actuator 103, the actuator 103 is instantly raised by the restoring force of push-button 102. When the actuator 103 rotates, the regulating member 104 contacts side 101C of the case 101 in order to stop the rotation of the actuator 103. However, the regulating member 104, as shown in FIG. 10, has problems adjusting the rotation of the actuator 103 due to an unstable folding angle. Moreover, when the actuator 103 is held up in a forceful manner, the regulating member 104 is pressed against side 101C of the case 101, thereby, distorting the regulating member 104. Therefore, the switch illustrated in FIGS. 10 and 11 is highly unreliable.

To solve the above-discussed problems, especially concerning the lever portion of the switch, this invention further provides a switch having a regulating member for rotating an actuator which can be manufactured with significant accuracy. Moreover, the switch of the instant invention is highly capable of maintaining it reliability during operation.

One feature of this invention is a switch with a simple structure and which has an improved life span because of the wiping of the surfaces of contact. Moreover, the switch of the instant invention comprises a switch having an outwardly protruding push-button for operating a contact switching mechanism housed within the case. Further, there is in this invention an actuator having at one end a pair of supporting members folded downwardly and rotatably engaged with the case, whereby the other end of the actuator is a free end. The supporting members of the actuator are formed in one piece with the regulating member which contacts one side of the case in order to stop the rotation of the actuator.

The foregoing and other objects, features and advantages of this invention will be apparent from the following, more particular, description of the preferred embodiments of this invention, as illustrated in the accompanying drawings.

DETAILED DESCRIPTION OF THE INVENTION

Figure 1:
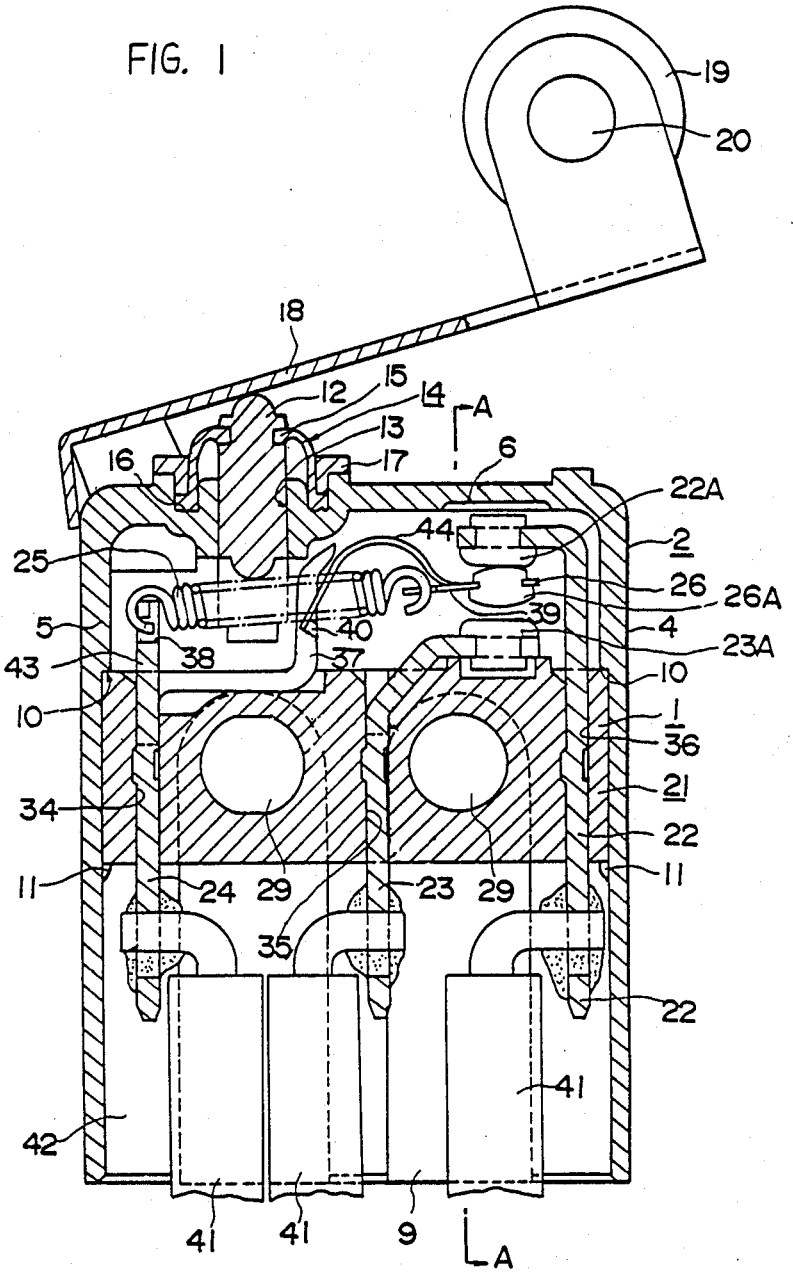
FIG. 1 is a vertical cross-sectional view of one embodiment in accordance with the present invention.
Figure 2:
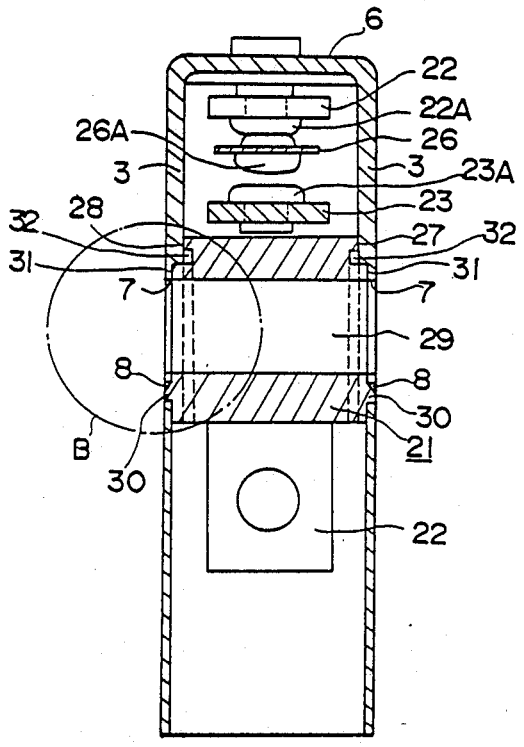
FIG. 2 is a cross-sectional view taken in the direction of arrows A—A shown in FIG. 1.
Figure 4:
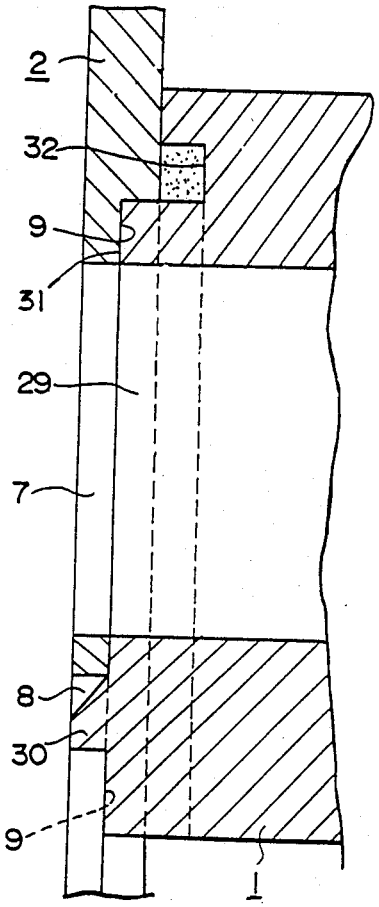
FIG. 4 is an enlarged view of portion B shown in FIG. 2.
Figure 3:
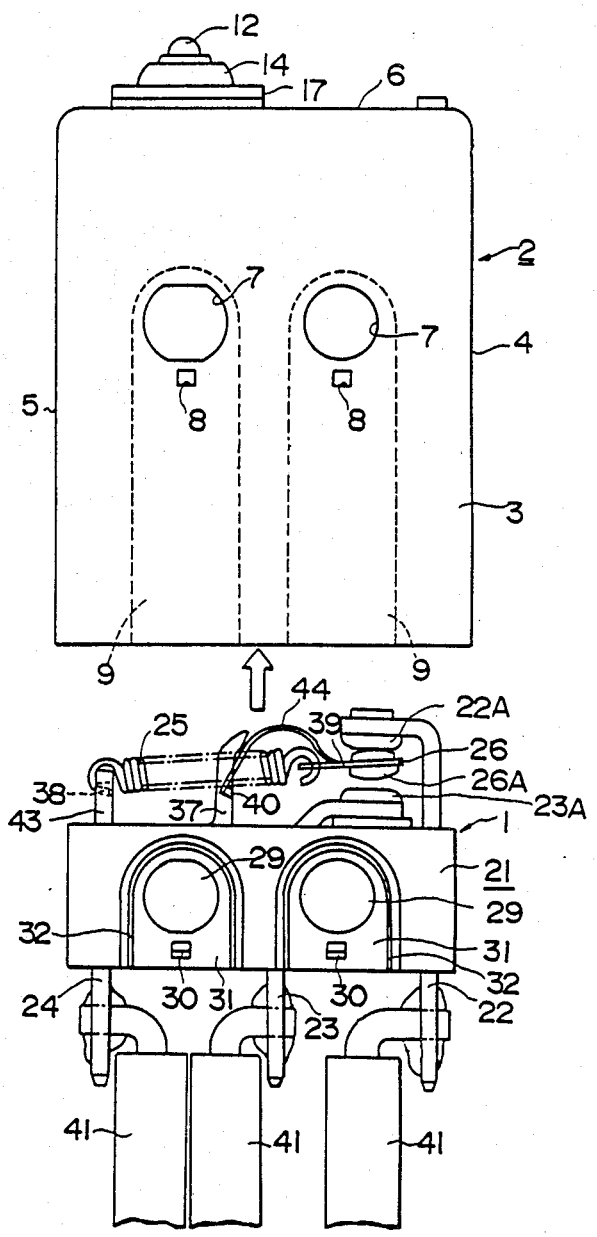
FIG. 3 is an exploded plan of view of FIG. 1.
Figure 5:
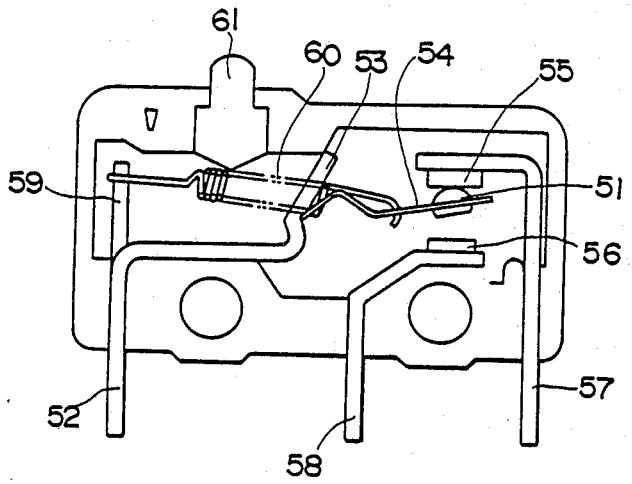
FIG. 5 (PRIOR ART)
FIG. 5 is a prior art switch.
Figure 6:
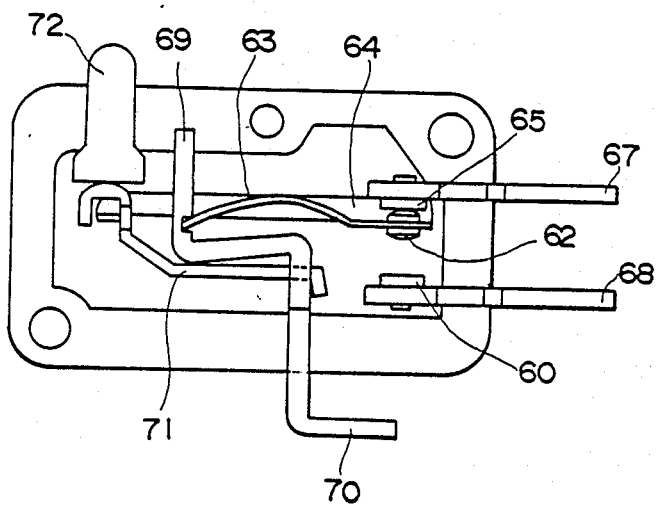
FIG. 6 (PRIOR ART)
FIG. 6 is another type of prior art switch.

Referring to FIGS. 1–4, the switch of this invention is divided into two parts as shown in FIG. 3, i.e., switch 1 and cover 2, which are designed to be separately assembled before the switch 1 is inserted into the cover 2. Cover 2 has slide walls 3, front wall 4, rear wall 5, and upper wall 6. The bottom of cover 2 has an opening into which the switch 1 is inserted. A pair of side walls 3 has two attachment passing holes 7 therethrough and two engagement holes 8. Inside the pair of side walls 3, there are provided grooves 9 which extend from the bottom of cover 2 and include the attachment through holes 7 and engagement holes 8. The internal surfaces of front wall 4 and rear wall 5 have steps 10 for positioning the upper limit of switch 1 inserted from the bottom of cover 2 and projections 11 for positioning the lower limit of switch 1. The upper wall 6 has a hole 13 through which a push-button 12 is attached to cover 2 through a water-resistant rubber cap 14. The cap 14 is tightly engaged in the groove 15 formed around the push-button 12. The lower portion of cap 14 is engaged in groove 16 which surrounds the hole 13. Another holding piece 17 presses the end of cap 14 over the groove 16. In this way, the push-button 12 is biased upwardly by elasticity of cap 16.

An end of actuator 18 is rotatably attached to the upper portion of cover 2. Actuator 18 is positioned to cover the push-button 12. The other end of the actuator 18 has a roller 19, the shaft 20 of which is rotatably mounted thereto.

Switch 1 is made up of base 21 made of resin, usually epoxy resin, a normally closed fixed terminal 22, a normally open fixed terminal 23, a common terminal 24, a movable coil spring 25, and a movable piece 26. The base 21 has passing through holes 29 which pass through between side surfaces 27 and 28 and confront face-to-face with attachment holes 7 of cover 2. The side surfaces 27 and 28 have engagement hooks 30 which engage with engagement holes 8. Side surfaces 27 and 28 of switch 1 have elevated areas 31 which meet with the groove 9 formed on an internal surface of side walls 3 of cover 2. Around the elevated areas 31, a lead-groove for seal 32 is provided which goes from the bottom of base 21, turns around passing through hole 29 and returns to the bottom of base 21.

The base 21 has three vertical passing-through holes 34, 35, and 36 into which the common terminal 24, normally open fixed terminal 23 and normally closed fixed terminal 22 are pressed, respectively. Normally closed terminal 22 and normally open terminal 23 have fixed contacts 22*a* and 23*a*, respectively, facing each other at one end of each terminal. The other ends of the terminals extend downwardly. The common terminal 24 has a standing piece 43 and folding piece 37 at one end, while the other end of common terminal 24 extends downwardly.

A movable coil spring 25 made of piano wire is mounted in a tensioned condition with one end hooked in hole 38 in standing piece 43 and the other end hooked in hole 39 defined in movable piece 26. The movable piece 26 has a movable plate spring 44 which stands out of movable piece 26 and is fitted into a notch 40 formed in a holding piece 37. A movable contact 26*a* is attached to an end of movable piece 26 which is biased by the movable plate spring 44 so as to make the movable contact 26*a* contact with the fixed contact 22*a*. Each terminal 22, 23 and 24 extending downwardly is soldered to a lead 41. In this way, separatelY assembled switch body 1 and cover 2 are coupled by inserting switch body 1 into cover 2.

The external contour of switch body 1 is designed to fit within the internal surface of cover 2 to have each side surface thereof contacted with the counterpart of cover 2. The insertion of switch body 1 continues until the upper surface of switch body 1 lands into step 10 on switch cover 2. At the same time, the projection 11 projects under switch body 1 thereby positioning the body 1 in the cover 2. In this condition, the bottom portion of push-button 12 rests on the upper portion of movable coil spring 25 and the attachment holes 7 of cover 2 confront face-to-face with the passing through holes 29 of switch 1. In addition, the engagement hook 30 of switch body 1 is fitted in the engagement hole 8 of cover 2 to strengthen the condition of their coupling. Further, the internal groove 9 of cover 2 is filled with elevated areas 31 of switch body 1.

After inserting switch body 1 into cover 2, the sealing resin, for example epoxy resin, is injected into space 42 defined in the lower portion of cover 2 with the cover 2 being upside down. Thus, the switch body 1 is fixed in the cover 2 with its terminals 22, 23 and 34 soldered to lead 41. When the resin is injected into cover 2, it passes through the lead-groove for seal 32 and secures the seal around the passing through holes 7 and 29 respectively defined in cover 2 and switch body 1, as well as the contacting portion between the engagement hole 8 and engagement hook 30, thereby preventing water coming therefrom.

A switch assembled in this way is mounted to an appliance for use by driving screws into holes 7 and 29. When an object strikes against roller 19 and actuator 18 is pressed down to depress push-button 12, the lower portion of push-button 12 presses the movable coil spring 25. If the push-button 12 passes over a certain point, then the movable plate spring 44 turns around to make the movable contact 26*a* come into contact with fixed contact 23*a*. When the pressing force to actuator 18 is removed, the push-button 12 is pushed up by the restoring force of movable coil spring 25 and the movable plate spring 44 turns around to bring the movable contact 26*a* again into contact with the fixed contact 22*a*.

It should be noted that when the movable contact 26*a* moves off the contact 22*a*, the spring force of movable coil spring 25 is added to the spring force of movable plate spring 44, so that the wiping effect takes place on the surfaces of contact 26*a*. On the contrary, when the movable contact 26*a* comes into contact with the other contact 23*a*, the spring force of movable plate spring 44 is added by the pressing force of movable coil spring 25 pressed by the push-button 12, so that the movable contact 26*a* is strongly pressed against the other contact 23*a*. As a result, greater wiping effect is achieved and larger contact pressure can be applied to the contact, thereby providing a switch of high-capacity type. In addition, the pressing force of push-button 12 is absorbed by the distortion of movable coil spring 25, which reduces excessive force applied to movable plate spring 44, thus expanding its life span.

Figure 7:
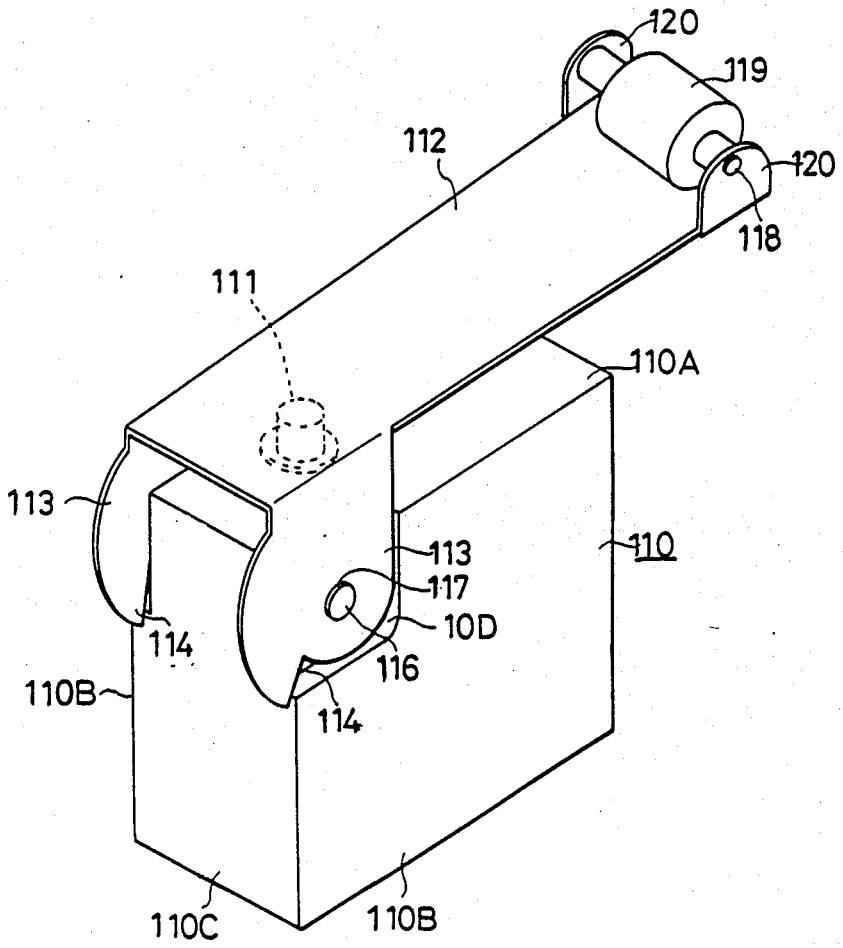
FIG. 7 is perspective view of another embodiment of the switch of the instant invention showing another embodiment of the actuator.
Figure 8:
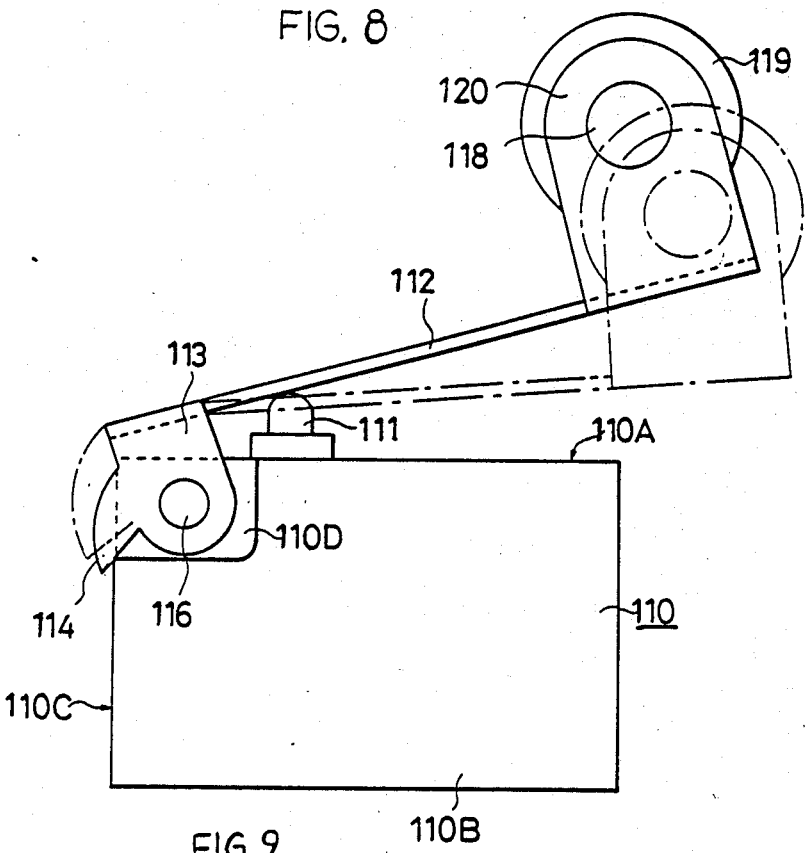
FIG. 8 is a side elevational view of the other embodiment of the switch shown in FIG. 7.
Figure 9:
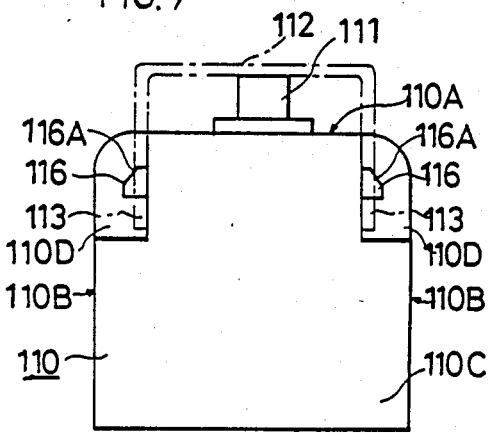
FIG. 9 is a rear elevational view of the other embodiment of the switch shown in FIG. 7.
Figure 10:
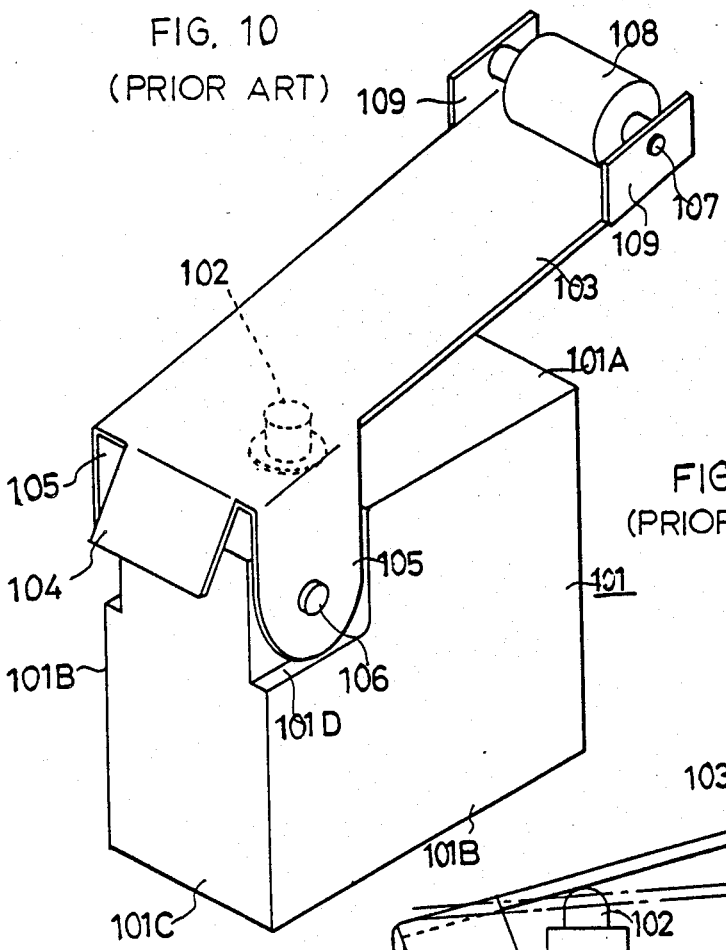
FIG. 10 (PRIOR ART)
FIG. 10 is a perspective view of another prior art switch.
Figure 11:
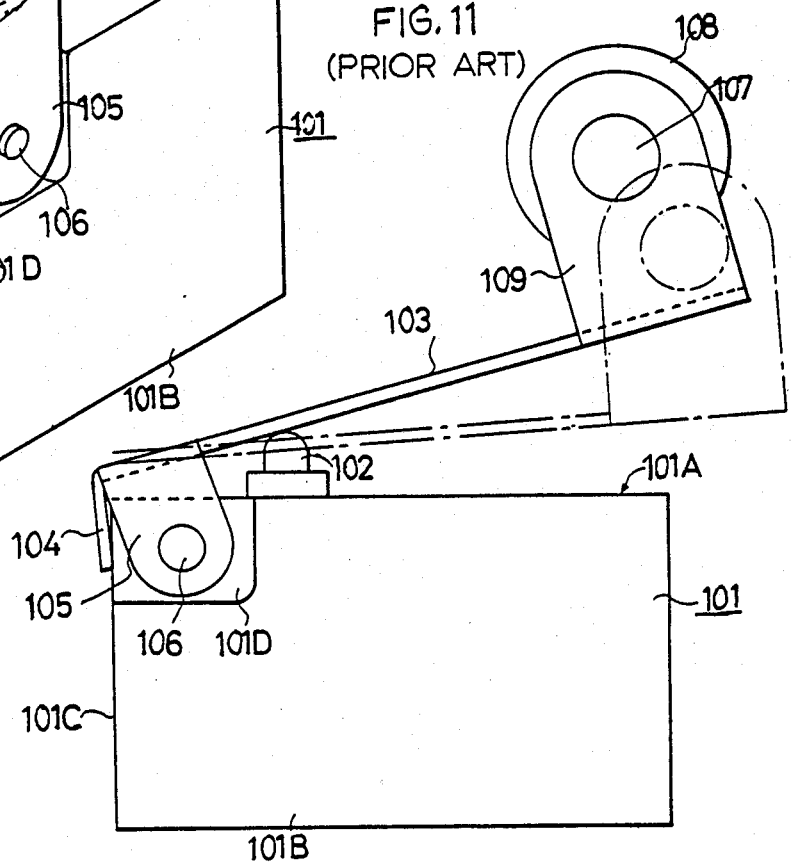
FIG. 11 (PRIOR ART)
FIG. 11 is a side elevational view of another prior art switch.

Referring now to FIGS. 7 and 8, a case 110 is shown preferably made out of resin for housing a contact switching mechanism. A top wall 110A of case 110 has a push-button 111 outwardly protruding therefrom. An actuator 112 is rotatably supported at one end so as to be capable of pressing the pushbutton 111. The actuator 112 has at one end a pair of metal portions which are downwardly folded to form a pair of supporting members 113. A pair of metal portions at the other end of the actuator 112 are upwardly folded to form roller supporting members 120. At the corners of side wall 110B of case 110, cuts 110D are provided for receiving supporting members 113. In the cuts 110D, a pair of pins 116 protrude to engage with holes 117 defined in the supporting members 113. As shown in FIG. 9, upper sides 116A of pins 116 are preferably sloped. In assembling the switch, a pair of supporting members 113 of actuator 112 are slidably pushed along the sloped portion of upper side 116A of pin 116 until hole 117 engages with the pins 116. The actuator 112 is rotatably held at one end by pressing a pair of protruding pins 116. A roller 119 has a rotary shaft 118 for engaging with a pair of holes defined in the roller supporting members 120.

Each supporting member 113 has a regulating member 114 which is formed in substantially the same plane of the supporting member 113. The regulating member 114 stops the rotation of the actuator 112 by contacting the rear wall 110C of the case 110. Normally, the actuator 112 is held by the returning force of push-button 111 and the pair of regulating members 114 which contact the rear wall portion 110C. When an object contacts the actuator 112, the actuator 112 is pushed in a downward direction and presses the push-button 111 against the button's returning force, thus, operating the switch contact mechanism housed within the case 110. When the pressing force on the push-button 111 is removed, the actuator 112 is instantly pushed upwards by the returning force of the push-button 111. The actuator 112 stops its rotation when the regulating members 114 contact the rear wall portion 110C. The regulating members 114 are formed in substantially the same plane as the supporting members 113. In other words, the regulating members 114 are formed substantially perpendicular to the rotary pin 116 so that the regulating members 114 do not deform even when a substantial external force is applied to the actuator 112. Preferably, the regulating members are molded together with the metal plate of the actuator 112 thereby minimizing the manufacturing tolerance or dimensional discrepancies.

While the invention has been particularly shown and described in reference to preferred embodiments thereof, it will be understood by those skilled in the art that changes in form and details may be made therein without departing from the spirit and scope of the invention.

What is claimed is:

1. A switch, comprising:

a movable piece having a movable contact;

an arcuate movable plate spring projecting from a side surface of the movable piece;

at least one fixed terminal provided with a fixed contact facing the movable contact;

a common terminal having a standing piece and a holding piece;

a movable coil spring having an end fixed to the standing piece of the common terminal, wherein the other end of the coil spring is coupled to an end of the movable piece, wherein the movable plate spring is biased by the movable coil spring, one end of the movable plate spring being swingably held by the holding piece of the common terminal, and wherein the coil spring and the movable plate spring provide wiping and contact pressure of the movable contact on the fixed terminal; and a push-button for directly pressing the upper portion of the movable coil spring.

2. The switch as in claim 1, further comprising a second fixed terminal provided with a second fixed contact also facing the movable contact.

3. The switch as in claim 2, wherein the fixed terminal is generally a closed fixed terminal and the second fixed terminal is generally an open fixed terminal.

4. The switch as in claim 2, wherein the movable contact contacts the fixed terminal and the second fixed terminal at different times.

5. The switch as in claim 1, wherein one end of the movable plate spring is fitted into a notch formed in the holding piece of the common terminal.

6. The switch as in claim 1, further comprising a switch cover having an internal step and internal projection for mounting the switch within the cover.

7. The switch as in claim 6, wherein the switch has passing through apertures for confronting face-to-face passing through holes of the cover.

8. The switch as in claim 6, wherein the switch has at least one lead groove for receiving sealing material.

9. The switch as in claim 1, further comprising an actuator for pressing on the push-button.

10. The switch as in claim 9, further comprising a roller rotatably coupled to one end of the actuator.

* * * * *